US010738730B2

(12) United States Patent
Nishida et al.

(10) Patent No.: US 10,738,730 B2
(45) Date of Patent: Aug. 11, 2020

(54) COOLING DEVICE FOR ENGINE

(71) Applicant: Mazda Motor Corporation, Aki-gun, Hiroshima (JP)

(72) Inventors: Ryotaro Nishida, Hiroshima (JP); Tomohiro Koguchi, Higashihiroshima (JP); Mikimasa Kawaguchi, Hiroshima (JP); Yuichi Ayukawa, Hiroshima (JP); Tatsuya Takahata, Hiroshima (JP); Takayuki Tominaga, Higashihiroshima (JP); Shinji Watanabe, Hiroshima (JP); Keita Watanabe, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

(21) Appl. No.: 16/051,883

(22) Filed: Aug. 1, 2018

(65) Prior Publication Data

US 2019/0040815 A1 Feb. 7, 2019

(30) Foreign Application Priority Data

Aug. 4, 2017 (JP) ..... 2017-151553

(51) Int. Cl.
*F02F 1/40* (2006.01)
*F01P 7/16* (2006.01)
(Continued)

(52) U.S. Cl.
CPC ..... *F02F 1/40* (2013.01); *F01P 3/02* (2013.01); *F01P 7/161* (2013.01); *F01P 7/165* (2013.01);
(Continued)

(58) Field of Classification Search
CPC ..... F02F 1/40; F02F 1/14; F02F 1/10; F02F 1/02; F02F 2001/106; F02F 1/24;
(Continued)

(56) References Cited

U.S. PATENT DOCUMENTS 7,237,513 B2 * 7/2007 Pfeffinger ..... F01P 7/162 123/41.29
2015/0159540 A1 6/2015 Misumi et al.
(Continued)

FOREIGN PATENT DOCUMENTS

JP 10325368 A 12/1998
JP 5223389 B2 6/2013
(Continued)

*Primary Examiner* — Grant Moubry
(74) *Attorney, Agent, or Firm* — Alleman Hall Creasman & Tuttle LLP

(57) ABSTRACT

A head-side jacket through which coolant flows is formed in a cylinder head. A main circulation path and a sub circulation path through which coolant fed from a coolant pump respectively circulates are formed. The head-side jacket is separated into an exhaust-port side jacket formed around an exhaust port, and a combustion-chamber-side jacket closer to a combustion chamber than the exhaust-port-side jacket. A heat exchanger is not formed in the main circulation path including the combustion-chamber-side jacket, but is formed in the sub circulation path excluding the combustion-chamber-side jacket and including the exhaust-port-side jacket.

1 Claim, 6 Drawing Sheets

(51) Int. Cl.
*F01P 3/02* (2006.01)
*F02F 1/14* (2006.01)

(52) U.S. Cl.
CPC ..... *F01P 7/167* (2013.01); *F02F 1/14* (2013.01); *F01P 2003/021* (2013.01); *F01P 2003/024* (2013.01)

(58) Field of Classification Search
CPC ..... F02F 1/243; F02F 1/26; F02F 1/36; F01P 7/165; F01P 7/167; F01P 2003/024; F01P 2003/028; F01P 3/02
See application file for complete search history.

(56) References Cited

U.S. PATENT DOCUMENTS

| | | | | |
|---|---|---|---|---|
| 2015/0211399 | A1* | 7/2015 | Knollmayr ..... | F01P 3/20<br>60/321 |
| 2016/0169081 | A1* | 6/2016 | Hosokawa ..... | F01P 7/16<br>123/41.08 |

FOREIGN PATENT DOCUMENTS

| | | | |
|---|---|---|---|
| JP | 2015108347 | A | 6/2015 |
| JP | 2015113706 | A | 6/2015 |

* cited by examiner

COOLING DEVICE FOR ENGINE

TECHNICAL FIELD

The present invention relates to a cooling device for an engine including an engine body having a cylinder block and a cylinder head for defining a combustion chamber, and a heat exchanger disposed outside the engine body.

BACKGROUND ART

Conventionally, there is known a structure for cooling an engine body by coolant fed from a coolant pump.

For example, Japanese Patent No. 5,223,389 discloses a cooling structure in which coolant fed from a coolant pump flows into an engine body, a part of coolant whose temperature is increased by cooling the engine body is returned to the coolant pump via an EGR cooler and a heater, and the coolant is fed to the engine body again.

In the structure disclosed in Japanese Patent No. 5,223,389, after all coolant fed from the engine body passes through heat exchangers such as an EGR cooler and a heater, and is warmed or cooled by the heat exchangers, the coolant is fed to the engine body again. In the aforementioned configuration, there is a problem that a temperature of coolant fed to the engine body is likely to vary depending on an amount of heat exchange in the respective heat exchangers, and a cooling state of a combustion chamber formed in the engine body is not stabilized. Further, accompanied by the unstable state, a combustion state of fuel-air mixture within the combustion chamber may also become unstable.

SUMMARY OF INVENTION

In view of the above, an object of the present invention is to provide a cooling device for an engine, which enables to stably and appropriately cool a combustion chamber formed in an engine body.

In order to solve the aforementioned problem, the present invention provides a cooling device for an engine including an engine body having a cylinder block and a cylinder head for defining a combustion chamber, and an exhaust port formed in the cylinder head, and a heat exchanger disposed outside the engine body. The cooling device includes: a coolant pump for feeding coolant into the engine body; a head-side jacket formed in the cylinder head, and through which coolant flows; and a circulation path through which coolant discharged from the coolant pump and returning to the coolant pump flows. The head-side jacket includes an exhaust-port-side jacket formed around the exhaust port in the cylinder head, and a combustion-chamber-side jacket formed at a position closer to the combustion chamber than the exhaust-port-side jacket. The circulation path includes a main circulation path through which coolant passing through the combustion-chamber-side jacket circulates, and a sub circulation path through which coolant passing through the exhaust-port-side jacket circulates. The heat exchanger is disposed at a downstream position of the sub circulation path with respect to the coolant pump, and at an upstream position of the sub circulation path with respect to the exhaust-port-side jacket.

According to the present invention, it is possible to stably and appropriately cool a combustion chamber formed in an engine body.

These and other objects, features and advantages of the present invention will become more apparent upon reading the following detailed description along with the accompanying drawings.

DESCRIPTION OF EMBODIMENTS

In the following, a cooling device for an engine according to an embodiment of the present invention is described with reference to the drawings.

(1) System Configuration

Figure 1:
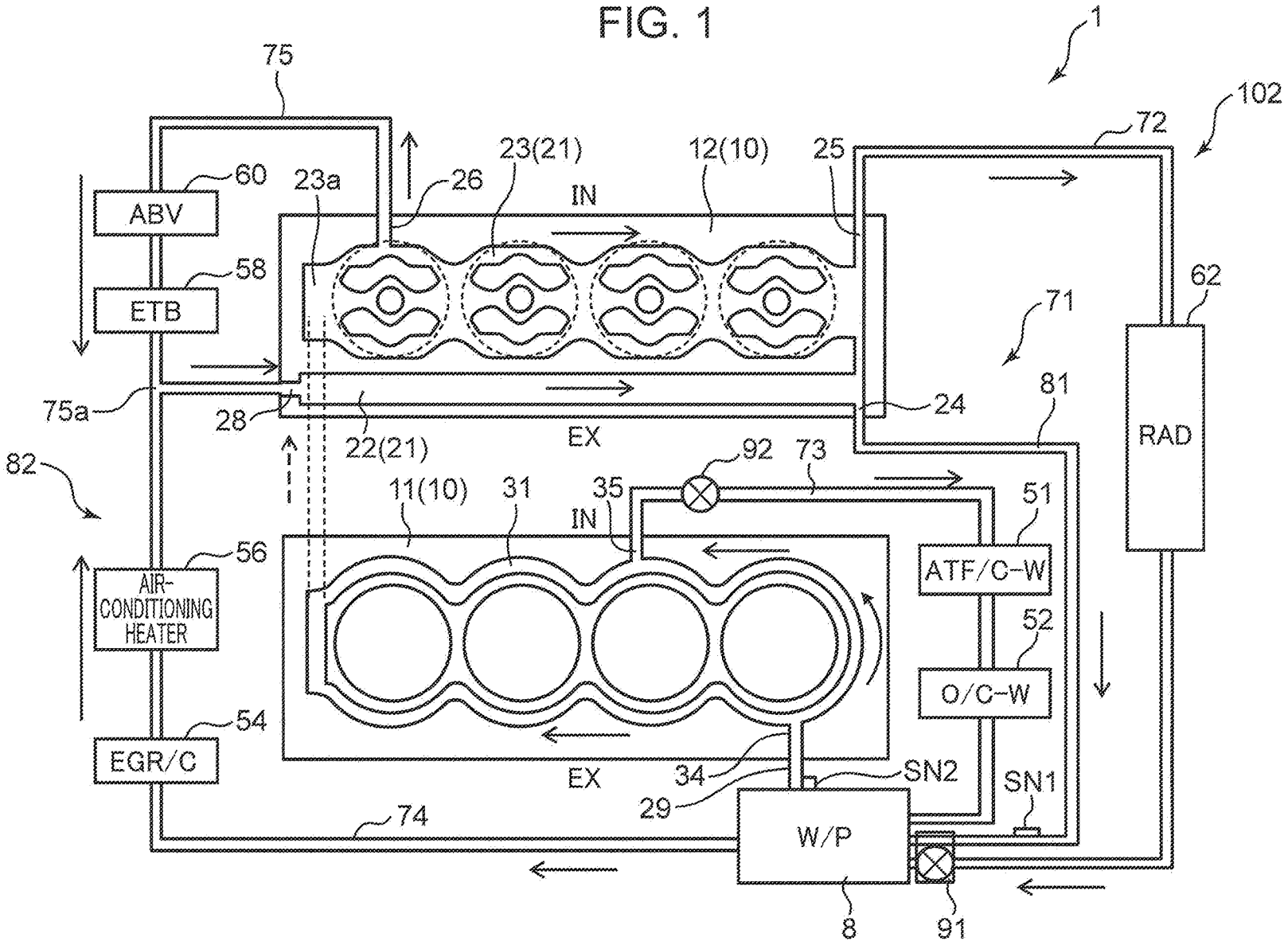
FIG. 1 is a schematic diagram illustrating an overall configuration of a cooling device for an engine according to an embodiment of the present invention.

FIG. 1 is a schematic diagram illustrating a preferred embodiment of an engine to which a cooling device according to the present invention is applied. An engine (hereinafter, referred to as an engine system) 1 includes an engine body 10 and a cooling device 102.

The engine system 1 includes a coolant pump 8 capable of discharging coolant, a first cooling passage (a main circulation path) 71, a second cooling passage 72, a third cooling passage 73, a fourth cooling passage 74, a fifth cooling passage (a branch path) 75 through which coolant discharged from the coolant pump 8 respectively flows, a radiator 62, first and second thermostats 91 and 92, and first and second pressure sensors SN1 and SN2. The engine system 1 includes an ECU (see FIG. 5, a control device) 100 for controlling respective components of the engine system 1 including the coolant pump 8.

Further, the engine system 1 includes an ATF temperature adjuster 51, an engine oil temperature adjuster 52, an EGR cooler (a heat exchanger) 54, an air-conditioning heater (a heat exchanger, an air-conditioning heater) 56, an electronic throttle body 58 (a member to be heated, hereinafter, referred to as an ETB 58), and an air bypass valve body 60 (a member to be heated, hereinafter referred to as an ABV 60).

The cooling device 102 includes at least the components 51, 52, 54, 56, 58, and 60; the coolant pump 8; the passages 71 to 75; the radiator 62; the first and second thermostats 91 and 92; the first and second pressure sensors SN1 and SN2; the ECU 100; and jackets 21 and 31 formed in the engine body 10, which will be described later.

In the embodiment, as illustrated in FIG. 1, the engine body 10 is an in-line 4-cylinder 4-cycle engine including four cylinders 2 aligned in a certain direction and each having a substantially cylindrical shape (a first cylinder, a second cylinder, a third cylinder, and a fourth cylinder in this order from the left side in FIG. 1). The engine body 10 is mounted in a vehicle as a drive source for the wheels. In the following, a direction in which the cylinders 2 are aligned or a left-right direction in FIG. 1 is referred to as a cylinder array direction or a left-right direction.

Intake passages (not illustrated) for introducing intake air to the respective cylinders 2, and exhaust passages (not illustrated) for discharging exhaust gas (gas after combustion) from the respective cylinders 2 are connected to the engine body 10.

The coolant pump 8 is a device which feeds coolant for cooling the engine body 10 to the engine body 10. The coolant pump 8 is constituted by a flow rate variable pump capable of changing a discharge amount of coolant. A mechanism for changing the discharge amount is not limited. As the coolant pump 8, it is possible to employ a device for mechanically changing the discharge amount, and a device for electrically changing the discharge amount. The coolant pump 8 includes a discharge portion for discharging coolant toward the engine body 10, and an introducing portion for introducing coolant after the engine body 10 is cooled.

In the embodiment, an EGR passage communicating between an exhaust passages and an intake passage, and configured to return a part of exhaust gas flowing through the exhaust passage (gas after combustion discharged from the engine body 10) to the intake passage. An EGR cooler 54 is a device for cooling EGR gas being gas flowing through the EGR passage. Specifically, passages through which EGR gas and coolant respectively flow are formed in the EGR cooler 54. EGR gas is cooled when EGR gas and coolant pass through the respective passages and heat exchange is performed between the EGR gas and the coolant.

Further, in the embodiment, a compressor (not illustrated) is provided in an intake passage, and air drawn into the engine body 10 is supercharged by the compressor. Further, a bypass passage for bypassing the compressor is connected to an intake passage. The ABV 60 is a valve for opening and closing the bypass passage, and is opened when a supercharged pressure by the compressor becomes excessively high, for example.

The ETB 58 is a device for changing a flow rate of air passing through an intake passage. The ETB 58 includes a throttle valve for opening and closing the intake passage, and a drive device such as a motor for driving the throttle valve.

The ABV 60 and the ETB 58 respectively include valves provided in an intake passage. When an outside air temperature is low, valves may be frozen within an intake passage before the engine is started. Therefore, it is necessary to forcibly increase the temperature of the valves at an early timing after the engine is started. In view of the above, it is necessary to warm the ABV 60 and the ETB 58 at least immediately after the engine is started. In the embodiment, a passage for flowing coolant around the valves is formed in the ABV 60 and the ETB 58. By flowing coolant through the passage, the valves are warmed.

The ATF temperature adjuster 51 is a device for warming or cooling automatic transmission fluid (ATF) being oil for an automatic transmission. In other words, in the embodiment, an automatic transmission capable of transmitting rotation of the engine body 10 to a shaft connected to an axle and the like, and changing a rotational speed of the shaft is connected to the engine. The ATF temperature adjuster 51 warms or cools ATF within the automatic transmission. Passages through which ATF and coolant respectively flow are formed in the ATF temperature adjuster 51. By flowing ATF and coolant through the passages, heat exchange is performed between the ATF and the coolant, and the ATF is warmed or cooled.

When a temperature of ATF is low, a viscosity thereof increases, and performance of an automatic transmission deteriorates. In view of the above, it is preferable to warm ATF, when a temperature of the ATF is low, for example, when the engine is started in a cold state. On the other hand, when a temperature of ATF is high, the ATF is likely to deteriorate. In view of the above, it is preferable to cool ATF, when a temperature of the ATF is high, for example, after the engine is warmed up, and an engine load is high.

The engine oil temperature adjustor 52 is a device for warming or cooling engine oil being lubricant oil for lubricating respective components of the engine body 10. Passages through which engine oil and coolant respectively flow are formed in the engine oil temperature adjuster 52. By flowing engine oil and coolant through the passages, heat exchange is performed between the engine oil and the coolant, and the engine oil is warmed or cooled.

When a temperature of engine oil is low, a viscosity thereof increases, lubrication performance deteriorates, and sliding resistance at respective components to which engine oil is supplied increases, which is not preferable. In view of the above, it is preferable to warm engine oil, when a temperature of the engine oil is low, for example, when the engine is started in a cold state. On the other hand, when a temperature of engine oil is high, the engine oil is likely to deteriorate. In view of the above, it is preferable to cool engine oil, when a temperature of the engine oil is high, for example, after the engine is warmed up, and an engine load is high.

The air-conditioning heater 56 is a heater for warming (air-conditioning) in order to introduce warm air into a vehicle compartment, and the like. Passages through which air and coolant respectively flow are formed in the air-conditioning heater 56. By flowing air and coolant through the passages, heat exchange is performed between the air and the coolant, and the air is warmed.

The radiator 62 is a device for cooling coolant. The radiator 62 cools coolant flowing through the radiator 62 by traveling wind of a vehicle, a cooling fan, and the like.

(i) Detailed Structure of Engine Body

Figure 2:
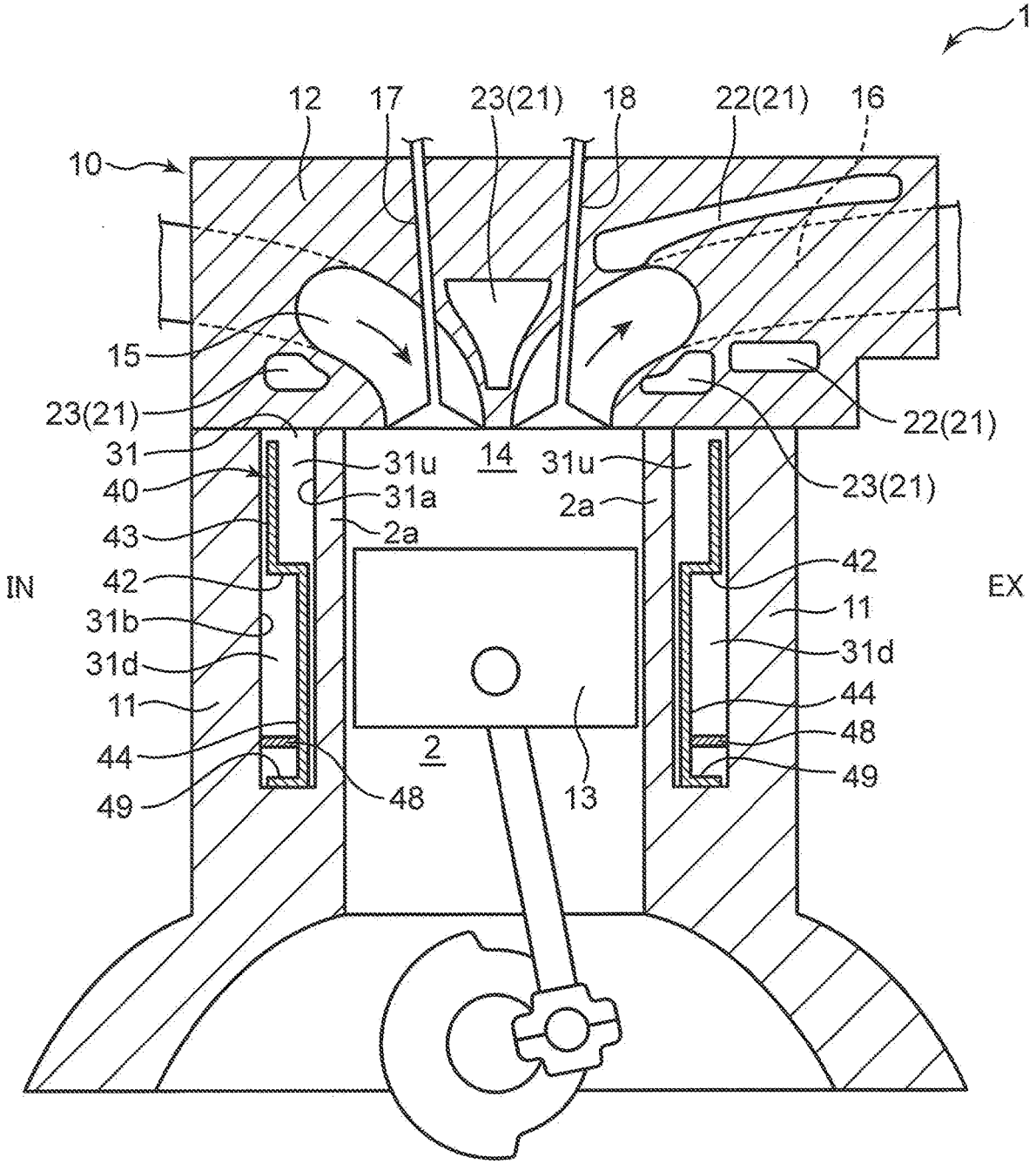
FIG. 2 is a schematic cross-sectional view of an engine body.

FIG. 2 is a schematic cross-sectional view of the engine body 10. In the following, the up-down direction in FIG. 2 is simply referred to as an up-down direction. Further, in the following, a radial direction of a cylinder is simply referred to as a radial direction, as necessary.

The engine body 10 includes a cylinder block 11 in which the four cylinders 2 are formed, and a cylinder head 12 located above the cylinder block 11 and engaged with the cylinder block 11 via a gasket (not illustrated).

A piston 13 is reciprocably received in an up-down direction within each cylinder 2. A combustion chamber 14 is defined above each piston 13 by the cylinder block 11 and the cylinder head 12. Specifically, the combustion chamber 14 is defined by an inner lateral surface of the cylinder 2, in other words, an inner peripheral surface of a cylinder bore wall 2*a*, a lower surface of the cylinder head 12, and an upper surface of the piston 13.

(Cylinder Head)

Each intake port 15 communicating with an intake passage and introducing intake air into the cylinder 2 (combustion chamber 14), and each exhaust port 16 communicating with an exhaust passage, and discharging gas after combustion from the cylinder 2 (combustion chamber 14) are formed in the cylinder head 12. In the embodiment, two intake ports 15 and two exhaust ports 16 are formed in each cylinder 2.

The intake ports 15 and the exhaust ports 16 are formed separately on one side and the other side of the engine body 10 in a width direction (the left-right direction in FIG. 2) orthogonal to the cylinder array direction with respect to a center axis of the cylinder. In the following, one side of the engine body 10 in the width direction of the engine body 10 where the intake ports 15 are formed is referred to as an intake side, and a side opposite to the intake side is referred to as an exhaust side, as necessary. Further, in FIG. 1 and the like, "EX" denotes an exhaust side, and "IN" denotes an intake side.

Each intake port 15 is opened and closed by an intake valve 17, and each exhaust port 16 is opened and closed by an exhaust valve 18.

The head-side jacket 21 through which coolant flows is formed in the cylinder head 12. As illustrated in FIG. 1, the head-side jacket 21 extends in the cylinder array direction.

The head-side jacket 21 is constituted by an exhaust-port-side jacket 22 formed around the exhaust port 16, and a combustion-chamber-side jacket 23 formed at a position closer to the combustion chamber 14 than the exhaust-port-side jacket 22.

Specifically, as illustrated in FIG. 2, the exhaust-port-side jacket 22 is formed only on the exhaust side of the cylinder head 12 (only on the exhaust side with respect to the center axis of the cylinder 2 in the width direction of the engine body 10). Further, the exhaust-port-side jacket 22 extends in the width direction of the engine body 10 along the exhaust port 16 immediately above the exhaust port 16 and immediately below the exhaust port 16.

On the other hand, as illustrated in FIG. 1 and FIG. 2, the combustion-chamber-side jacket 23 is formed in an area below the exhaust port 16 and closer to the combustion chamber 14 than the exhaust-port-side jacket 22, at a position below the intake port 15, and near the center axis of the cylinder. In other words, the combustion-chamber-side jacket 23 is formed substantially over the entirety of a portion facing the combustion chamber 14 at a lower portion of the cylinder head 12 and its periphery, except for a portion near the center axis of the cylinder where the ports 15 and 16, the valves 17 and 18, an unillustrated injector, and an unillustrated spark plug are provided.

A left end of the combustion-chamber-side jacket 23 (an end of the first cylinder in the cylinder array direction) is opened toward the lower surface of the cylinder head 12, and functions as a main communication portion 23*a* communicating between the combustion-chamber-side jacket 23 and the block-side jacket 31 to be described later.

A first head-side discharge portion 24 and a second head-side discharge portion 25 respectively communicating with the combustion-chamber-side jacket 23 and the exhaust-port-side jacket 22 and respectively opened toward an outer lateral surface of the cylinder head 12 are formed in a right end of the cylinder head 12. In the embodiment, the first head-side discharge portion 24 is opened toward an outer lateral surface of the cylinder head 12 on the exhaust side, and the second head-side discharge portion 25 is opened toward an outer lateral surface of the cylinder head 12 on the intake side.

Further, in the embodiment, a third head-side discharge portion 26 communicating with the combustion-chamber-side jacket 23 and opened toward the outer lateral surface of the cylinder head 12 is formed near a left end of the cylinder head 12 and at a position slightly on the right side than the main communication portion 23*a*. The third head-side discharge portion 26 is opened toward the outer lateral surface of the cylinder head 12 on the intake side. Further, the third head-side discharge portion 26 communicates with a portion of the combustion-chamber-side jacket 23 located above the first cylinder 2, which is located at a left end of the combustion-chamber-side jacket 23.

Further, a head-side coolant introducing portion 28 communicating with the exhaust-port-side jacket 22 and opened toward the outer lateral surface of the cylinder head 12 is formed in the left end of the cylinder head 12. The head-side coolant introducing portion 28 is opened toward a left end surface of the cylinder head 12.

(Cylinder Block)

The block-side jacket 31 through which coolant flows is formed in the cylinder block 11. As illustrated in FIG. 1, the block-side jacket 31 is formed to surround the cylinders 2, and extends in the cylinder array direction.

A block-side coolant introducing portion 34 communicating with the block-side jacket 31 and opened toward an outer lateral surface of the cylinder block 11 on the exhaust side is formed in the cylinder block 11. The coolant pump 8 is disposed near the block-side coolant introducing portion 34, and communicates with the block-side coolant introducing portion 34 via a main pump discharge passage 29. Coolant discharged from the coolant pump 8 is introduced to the block-side coolant introducing portion 34. For example, the coolant pump 8 is mounted at a position in proximity to an opening portion of the block-side coolant introducing portion 34 out of an outer lateral surface of the cylinder block 11 toward which the block-side coolant introducing portion 34 is opened.

The block-side coolant introducing portion 34 is formed in a right end of the cylinder block 11 and in an end on a side opposite to the main communication portion 23*a* in the left-right direction. The block-side coolant introducing portion 34 is opened near a right end on the outer lateral surface of the cylinder block 11 on the exhaust side. For example, a block-side coolant discharge portion 35 is formed in a position facing the third cylinder.

Further, the block-side coolant discharge portion 35 communicating with the block-side jacket 31 and opened toward the outer lateral surface of the cylinder block 11 on the intake side is formed in the cylinder block 11. The block-side coolant discharge portion 35 is formed in a portion on a left side than the block-side coolant introducing portion 34 in the left-right direction.

A spacer member 40 is accommodated within the block-side jacket 31 to separate an inner space of the block-side jacket 31 into a radially inner portion and a radially outer portion (a portion on a combustion-chamber side and a portion on a side opposite to the combustion-chamber side). In FIG. 1, the spacer member 40 is omitted.

Figure 3:
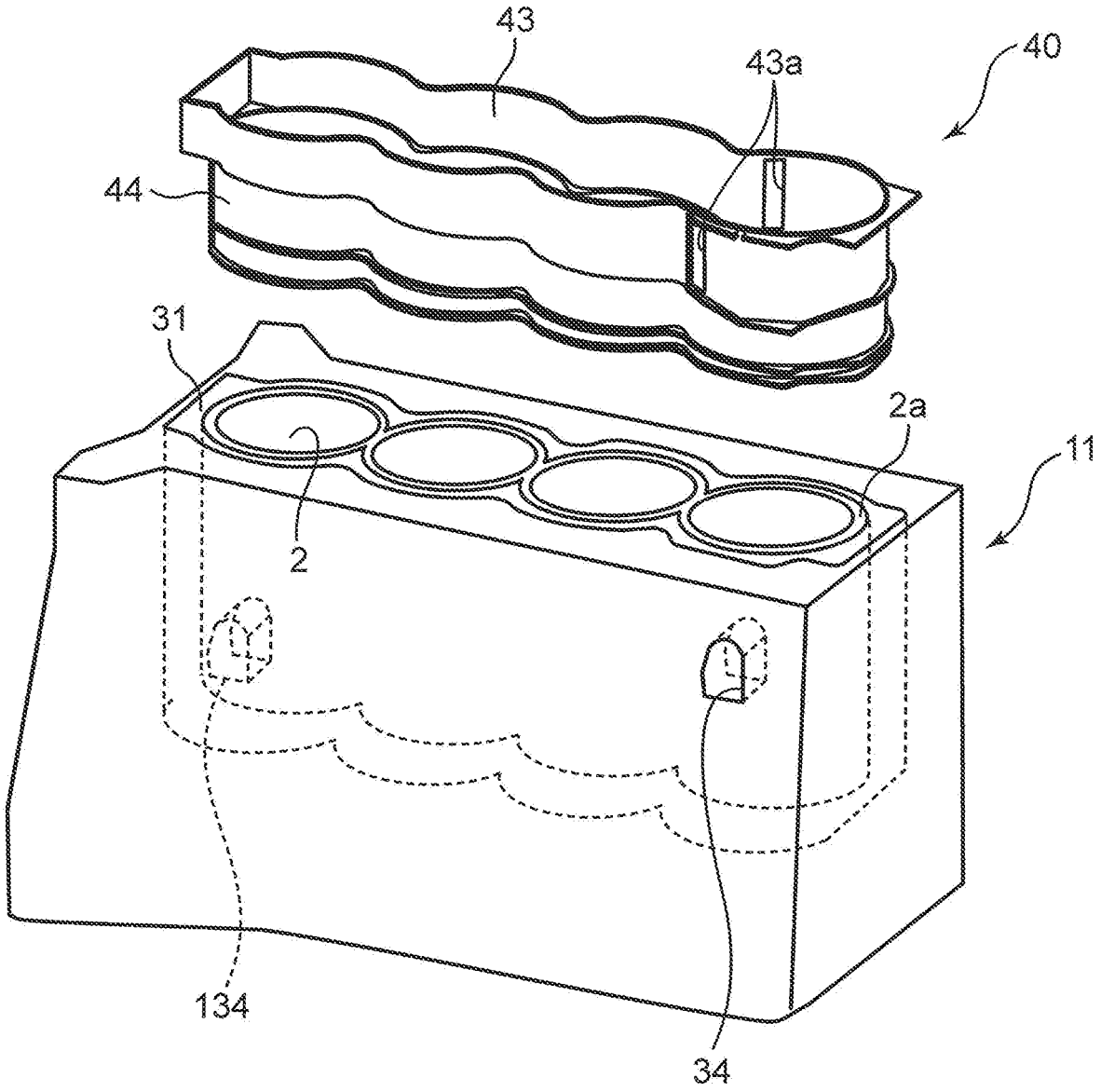
FIG. 3 is an exploded perspective view illustrating a schematic configuration of a cylinder block and its periphery.
Figure 4:
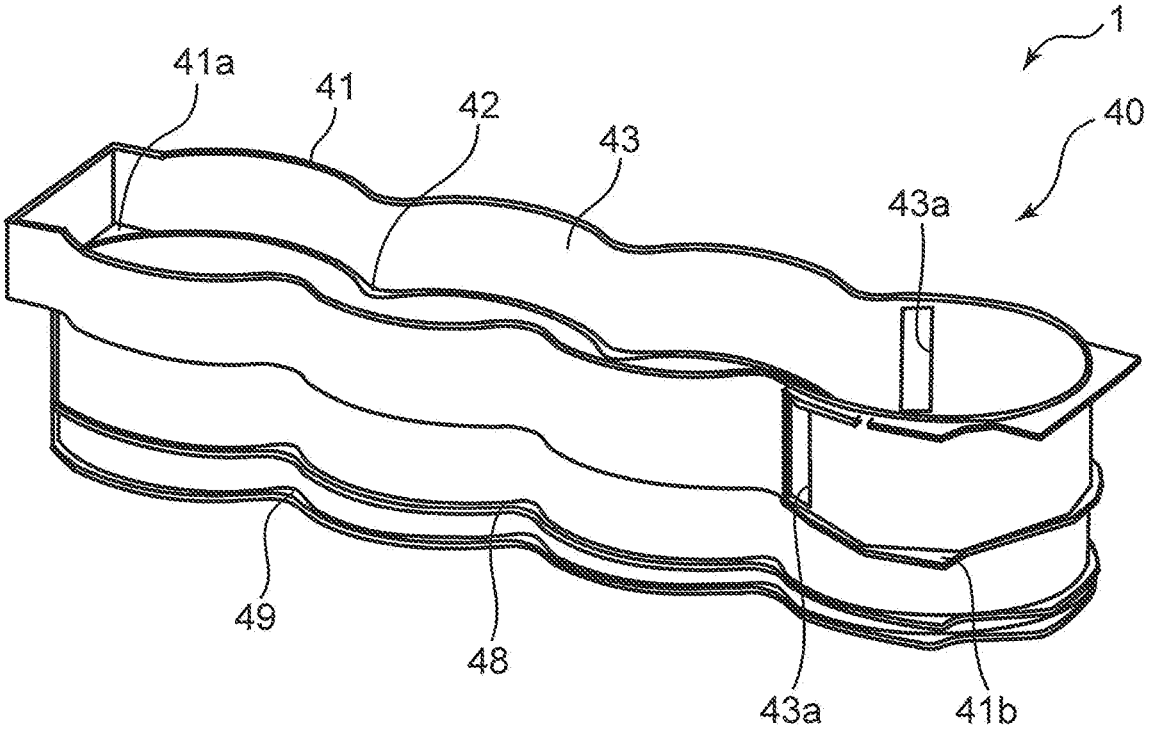
FIG. 4 is a perspective view of a spacer member when viewed from the exhaust side.

FIG. 3 is an exploded perspective view illustrating a schematic configuration of the cylinder block 11 and its periphery. FIG. 4 is a perspective view of the spacer member 40 when viewed from the exhaust side.

The spacer member 40 includes a spacer body portion 41, a first flange 49 located at a lower end of the spacer member 40, and a second flange 48 located on the upper side than the first flange 49. The spacer member 40 is made of a material (e.g. synthetic resin) of thermal conductivity smaller than a material of the cylinder block 11 (e.g. aluminum alloy), for example.

The first flange 49 projects radially outwardly over the entire periphery from a radially outer periphery of a lower end of the spacer body portion 41 (projects from the combustion chamber 14 side toward the side opposite to the combustion chamber 14). The spacer member 40 is accommodated within the block-side jacket 31 in a state that the first flange 49 comes into contact with a bottom surface of the block-side jacket 31.

The second flange 48 also projects radially outwardly substantially over the entire periphery from an outer peripheral surface of the spacer body portion 41 on the upper side than the first flange 49.

The spacer body portion 41 is a member surrounding the entirety of an outer periphery of the cylinder bore wall 2*a* associated with each cylinder 2. Specifically, the spacer body portion 41 has a tubular shape such that four circles in a plan view slightly overlap each other along the cylinder bore wall 2*a*, with the overlapped portions being removed.

The spacer body portion 41 has a height substantially the same as the depth of the block-side jacket 31. According to this configuration, substantially the entirety of the block-side jacket 31 is separated into a radially inner portion (a portion on the combustion-chamber 14 side) and a radially outer portion (a portion on the side opposite to the combustion chamber 14) substantially over the entirety by the spacer body portion 41.

The spacer body portion 41 includes an upper wall 43 surrounding an upper portion of the cylinder bore wall 2*a* associated with each cylinder 2 (e.g. a portion corresponding to about upper one-third in a moving range of a top surface of the piston 13 in the up-down direction), a step portion 42 continued to a lower end of the upper wall 43 and projecting radially inwardly, and a lower wall 44 continued to an inner end of the step portion 42 and located on the lower side of the upper wall 43. The spacer body portion 41 has a stepped tubular shape such that the lower wall 44 is indented with respect to the upper wall 43.

As illustrated in FIG. 2, a distance between a radially inner surface 31*a* of the block-side jacket 31 and the upper wall 43 is larger than a distance between a radially outer surface 31*b* of the block-side jacket 31 and the upper wall 43. On the other hand, a distance between the radially inner surface 31*a* of the block-side jacket 31 and the lower wall 44 is smaller than a distance between the radially outer surface 31*b* of the block-side jacket 31 and the lower wall 44. According to this configuration, a flow path 31*u* (hereinafter, referred to as an upper flow path, as necessary) having a large flow area at a radially inner position than the spacer member 40, in other words, at a position close to the combustion chamber 14 is defined at an upper portion of the block-side jacket 31. A flow path 31*d* (hereinafter, referred to as a lower flow path, as necessary) having a large flow area at a radially outer position than the spacer member 40, in other words, at a position far from the combustion chamber 14 is defined at a lower portion of the block-side jacket 31.

As illustrated in FIG. 3 and FIG. 4, the block-side coolant introducing portion 34 faces a portion near a right end of the spacer body portion 41 in a state that the spacer member 40 is accommodated within the block-side jacket 31. Note that the step portion 42 projecting radially inwardly is not formed on the right end of the spacer body portion 41 facing the block-side coolant introducing portion 34. The spacer body portion 41 extends in the up-down direction on the right end of the spacer body portion 41 in proximity to the radially inner surface 31*a* of the block-side jacket 31. Further, a partition wall 41*b* projecting radially outwardly from the spacer body portion 41 is formed on the right end of the spacer body portion 41. The partition wall 41*b* is formed at a substantially same height position as the step portion 42. The block-side coolant introducing portion 34 extends from a position higher than the partition wall 41*b* to a position lower than the partition wall 41*b*.

Coolant guiding holes 43*a* and 43*a* passing through the upper wall 43 are respectively formed in both walls of the upper wall 43 on the exhaust side and the intake side at positions on the left side than the block-side coolant introducing portion 34 in the left-right direction.

Further, a communication hole 41*a* passing through a left end of the step portion 42 in the up-down direction is formed in the left end of the step portion 42. Further, the upper flow path 31*u* and the lower flow path 31*d* communicate with each other via the communication hole 41*a*.

In the cylinder block 11 configured as described above, coolant flows as follows.

First of all, coolant is introduced from the coolant pump 8 into the block-side coolant introducing portion 34. Then, the coolant is introduced from the block-side coolant introducing portion 34 into the block-side jacket 31. At this occasion, a part of the coolant is introduced to a lower portion of the partition wall 41*b* and flows into the lower flow path 31*d*, and the remaining part of the coolant is introduced to an upper portion of the partition wall 41*b*.

The coolant is separated into a left part and a right part from the block-side coolant introducing portion 34 within the lower flow path 31*d*. A part of the coolant passes through a portion of the lower flow path 31*d* on the exhaust side; and a part of the coolant flows through a portion of the lower flow path 31*d* on the intake side, and is directed toward a left end of the lower flow path 31*d*. Then, the coolant within the lower flow path 31*d* flows into the upper flow path 31*u* through the communication hole 41*a* on the left end of the lower flow path 31*d*.

Further, after being separated into a left part and a right part from the block-side coolant introducing portion 34, the coolant introduced to the upper portion of the partition wall 41*b* flows into the upper flow path 31*u* through the coolant guiding holes 43*a* on the intake side and the exhaust side. Then, the coolant flows leftwardly within the upper flow path 31*u* on the intake side and the exhaust side.

The coolant flowing through the upper flow path 31*u* and the coolant flowing through the lower flow path 31*d* merge in a left end of the upper flow path 31*u*. Then, after merging, the coolant flows into the combustion-chamber side jacket 23 through the main communication portion 23*a*. In other words, in the embodiment, the main communication portion 23*a* communicates with a left end of the upper flow path 31*u* of the block-side jacket 31. The coolant flows into the combustion-chamber-side jacket 23 through the main communication portion 23*a* from the left end of the upper flow path 31*u*.

(ii) Cooling Passage (First Cooling Passage)

The first cooling passage 71 is a passage for returning coolant discharged from the coolant pump 8 to the coolant pump 8 after the coolant flows within the engine body 10. The first cooling passage 71 is constituted by the main pump discharge passage 29 connecting the coolant pump 8 and the block-side coolant introducing portion 34, the block-side jacket 31, the combustion-chamber-side jacket 23, the first head-side discharge portion 24, and a main communication passage 81 connecting an opening portion of the first head-side discharge portion 24 and the coolant pump 8. According to this configuration, coolant fed from the coolant pump 8 circulates within the first cooling passage 71. In this way, the first cooling passage 71 serves as a path (a main circulation path) through which coolant flowing through the combustion-chamber-side jacket 23 circulates.

As described above, a part of coolant discharged from the coolant pump 8 flows into the block-side jacket 31 via the block-side coolant introducing portion 34 and the main pump discharge passage 29. Then, after passing through the upper flow path 31*u* and the lower flow path 31*d*, the coolant flows into the combustion-chamber-side jacket 23 through the main communication portion 23*a*.

As illustrated in FIG. 1, coolant flows from the main communication portion 23*a* toward a side (toward a right side) opposite to the main communication portion 23*a* within the combustion-chamber-side jacket 23. The coolant that reaches a right end of the combustion-chamber-side jacket 23 through the combustion-chamber-side jacket 23 flows into the first head-side discharge portion 24, and returns to the coolant pump 8 from the first head-side discharge portion 24 through the main communication passage 81.

A sensor for detecting a difference in pressure of coolant regarding the coolant pump 8, which is a difference between a pressure of coolant in an upstream portion with respect to the coolant pump 8, and a pressure of coolant in a downstream portion with respect to the coolant pump 8, is provided in the first cooling passage 71. In the embodiment, the first pressure sensor N1 for detecting a pressure of coolant in a portion immediately upstream of the coolant pump 8, and the second pressure sensor N2 for detecting a pressure of coolant in a portion immediately downstream of the coolant pump 8 are provided in the first cooling passage 71. A difference in pressure of coolant regarding the first cooling passage 71 is detected by a difference between pressures detected by the first and second pressure sensors SN1 and SN2.

(Second Cooling Passage)

The second cooling passage 72 is a passage for returning coolant separated from the first cooling passage 71 to the coolant pump 8 after the coolant is cooled by the radiator 62. In the embodiment, the second cooling passage 72 connects an opening portion of the second head-side discharge portion 25 and the coolant pump 8. Further, the radiator 62 is provided between the second head-side discharge portion 25 and the coolant pump 8 in the second cooling passage 72. Coolant discharged from the second head-side discharge portion 25 is cooled by the radiator 62.

The first thermostat 91 is provided in the second cooling passage 72, and opens and closes the second cooling passage 72 depending on a temperature of coolant. Specifically, the first thermostat 91 includes a detecting portion for detecting a temperature of coolant, and a valve for switching the second cooling passage 72 between a fully closed state and a fully opened state depending on a detection result by the detecting portion. In the embodiment, coolant passing through the main communication passage 81 flows into the detecting portion of the first thermostat 91. The valve is opened when a temperature of coolant within the main communication passage 81 reaches a first reference temperature, which is set in advance, or higher.

(Third Cooling Passage)

The third cooling passage 73 is a passage for returning coolant to the coolant pump 8 after the coolant separated from the first cooling passage 71 passes through the ATF temperature adjuster 51 and the engine oil temperature adjuster 52. In the embodiment, the third cooling passage 73 connects an opening portion of the block-side coolant discharge portion 35 and the coolant pump 8. After coolant flows into the block-side jacket 31 from the coolant pump 8 via the block-side coolant introducing portion 34, a part of the coolant fed to a portion of the block-side jacket 31 on the intake side flows into the third cooling passage 73.

The second thermostat 92 is provided in the third cooling passage 73, and opens and closes the third cooling passage 73 depending on a temperature of coolant. Specifically, the second thermostat 92 includes a detecting portion for detecting a temperature of coolant, and a valve for switching the third cooling passage 73 between a fully closed state and a fully opened state depending on a detection result by the detecting portion. The second thermostat 92 is located on the upstream side with respect to the ATF temperature adjuster 51 in the third cooling passage 73. Coolant of a temperature substantially equal to a temperature of the block-side jacket 31 flows into the detecting portion of the second thermostat 92. The valve of the second thermostat 92 is opened when a temperature of coolant within the block-side jacket 31, consequently, a temperature of coolant within the first cooling passage 71 reaches a second reference temperature, which is set in advance, or higher.

The second reference temperature is set lower than the first reference temperature.

(Fourth Cooling Passage)

The fourth cooling passage 74 connects the coolant pump 8 and the exhaust-port-side jacket 22. More specifically, the fourth cooling passage 74 is connected to the coolant pump 8 and to an opening portion of the head-side coolant introducing portion 28 communicating with the exhaust-port-side jacket 22. According to this configuration, in the embodiment, the fourth cooling passage 74, the exhaust-port-side jacket 22, and the main communication passage 81 constitute a sub circulation path 82 through which coolant circulates. An amount of coolant flowing through the sub circulation path 82 is small, as compared with an amount of coolant flowing through the first cooling passage (main circulation path) 71. By reducing the amount of coolant flowing through the sub circulation path 82, it is possible to enhance heat exchange performance (heating and cooling performance). In this way, the sub circulation path 82 serves as a path through which coolant flowing through the exhaust-port-side jacket 22 circulates. Further, in the engine system 1, the sub circulation path 82 and the first cooling passage 71 are provided as a circulation path through which coolant discharged from the coolant pump 8 and returning to the coolant pump 8 flows.

The EGR cooler 54 and the air-conditioning heater 56 are provided in the fourth cooling passage 74. The EGR cooler 54 is located on the upstream side with respect to the air-conditioning heater 56 in the third cooling passage 73.

EGR gas flowing through the EGR cooler 54 is gas after combustion. A temperature of EGR gas is higher than a temperature of coolant. Therefore, coolant within the EGR cooler 54 cools EGR gas, and a temperature of the coolant increases, as the coolant cools the EGR gas. Thereafter, the coolant is introduced to the air-conditioning heater 56, heat exchange is performed between the coolant and air within the air-conditioning heater 56, and the air is warmed. A temperature of the coolant introduced to the air-conditioning heater 56 is increased within the EGR cooler 54. Therefore, the coolant effectively warms the air within the air-conditioning heater 56.

The coolant discharged from the air-conditioning heater 56 flows into the exhaust-port-side jacket 22 via the head-side coolant introducing portion 28. As illustrated in FIG. 1, coolant flows from the head-side coolant introducing portion 28 toward a side (toward a right side) opposite to the head-side coolant introducing portion 28 within the exhaust-port-side jacket 22. The coolant that reaches a right end of the exhaust-port-side jacket 22 through the exhaust-port-side jacket 22 flows into the first head-side discharge portion 24. Then, the coolant returns from the first head-side discharge portion 24 to the coolant pump 8 through the main communication passage 81.

(Fifth Cooling Passage)

The fifth cooling passage (the branch path) 75 connects the combustion-chamber-side jacket 23 and a midway portion of the fourth cooling passage 74. Specifically, the fifth cooling passage 75 connects a downstream portion of the fourth cooling passage 74 with respect to the air-conditioning heater 56, and the third head-side discharge portion 26. The ABV 60 and the ETB 58 are provided in the fifth cooling passage 75. In the following, a connection portion between the fifth cooling passage 75 and the fourth cooling passage 74 is referred to as a connection portion 75*a*.

Coolant flows from the third head-side discharge portion 26 toward the connection portion 75*a* in the fifth cooling passage 75. Coolant discharged from the third head-side discharge portion 26 and being a part of coolant within the combustion-chamber-side jacket 23 flows into the connection portion 75*a*.

Coolant flowing through the fifth cooling passage 75 is coolant within the combustion-chamber-side jacket 23 as described above. A temperature of the coolant is increased since the coolant passes through the entirety of the block-side jacket 31 and through a part of the combustion-chamber-side jacket 23. Thus, by introducing the coolant whose temperature is increased, the ABV 60 and the ETB 58 are warmed. More specifically, as described above, since coolant flows through passages respectively provided for the ABV 60 and the ETB 58, respective valves of the ABV 60 and the ETB 58 are warmed. A relative positional relationship between the ABV 60 and the ETB 58 is not specifically limited. In the embodiment, the ABV 60 is provided upstream of the ETB 58, and coolant discharged from the third head-side discharge portion 26 is introduced to the ABV 60 first of all.

(2) Control System

Figure 5:
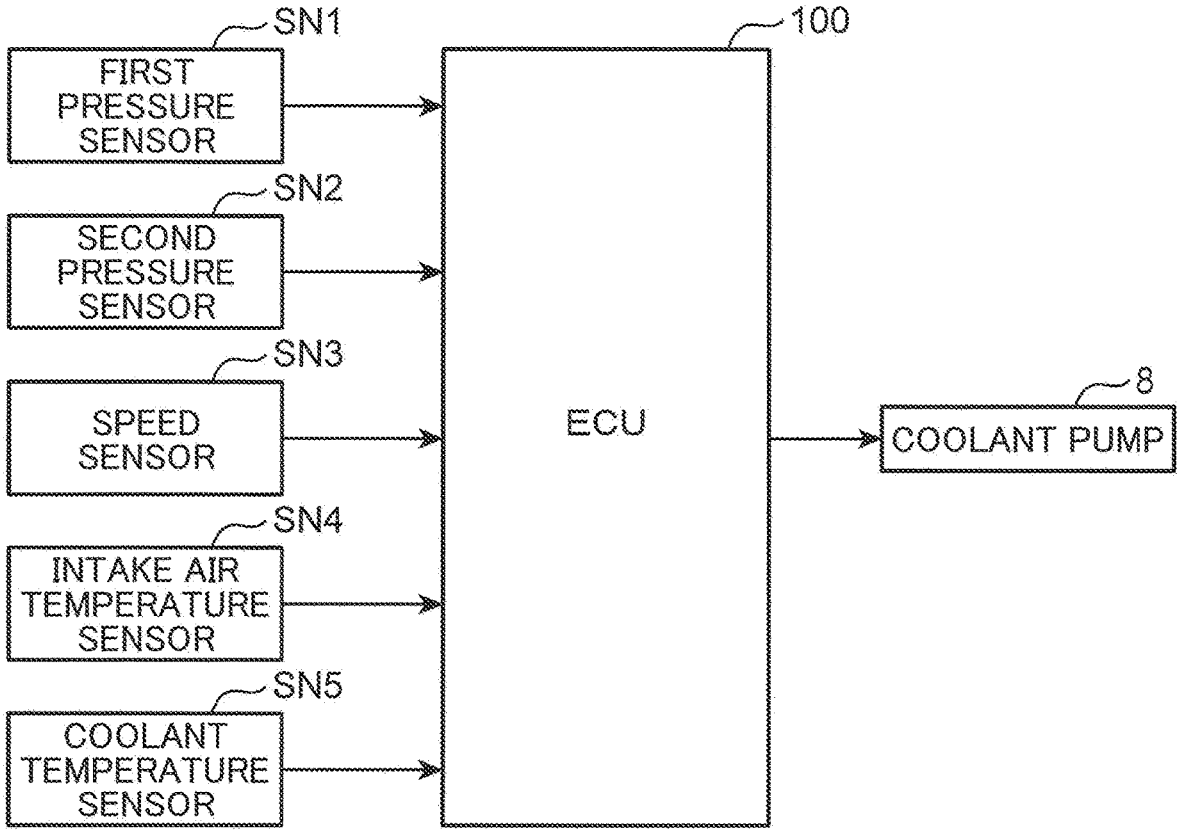
FIG. 5 is a diagram illustrating a control block of the engine according to the embodiment of the present invention.

FIG. 5 is a block diagram of a control system according to the embodiment.

The ECU 100 is a device for controlling respective components of the engine system 1 including the coolant pump 8. As is well-known, the ECU 100 is a microprocessor constituted by a CPU, an ROM, an RAM, and the like.

The ECU 100 is connected to the first pressure sensor SN1, the second pressure sensor SN2, and other various types of sensors. Detection results of these sensors are input to the ECU 100. For example, detection results of a speed sensor SN3 for detecting a speed of the engine body 10, an intake air temperature sensor SN4 for detecting a temperature of intake air flowing through an intake passage, a coolant temperature sensor SN5 for detecting a temperature of coolant, and the like are input to the ECU 100. The coolant temperature sensor SN5 detects a temperature of coolant within the combustion-chamber-side jacket 23, for example.

The ECU 100 controls the coolant pump 8, based on detection results of these sensors, and changes a discharge flow rate of the coolant pump 8. Further, the ECU 100 switches between driving and stopping of the coolant pump 8.

The ECU 100 stops the coolant pump 8, when the engine is started in a cold state, and a temperature of coolant detected by the coolant temperature sensor SN5 is lower than a predetermined pump driving temperature, in other words, a temperature of coolant detected by the coolant temperature sensor SN5 is lower than a temperature of coolant within the combustion-chamber-side jacket 23, consequently, a temperature of the engine body 10. Further, when a temperature of coolant increases accompanied by driving of the engine body 10, and a temperature of coolant detected by the coolant temperature sensor SN5 reaches the pump driving temperature or higher, the ECU 100 drives the coolant pump 8. The pump driving temperature is set lower than the first reference temperature and the second reference temperature.

In this way, in the embodiment, when a temperature of coolant is lower than the pump driving temperature, driving of the coolant pump 8 is stopped, and flowing of coolant within respective passages is stopped. Therefore, in a condition that the engine is started in a cold state, for example, and a temperature of coolant is lower than the pump driving temperature, it is possible to suppress that heat of the engine body 10 is deprived of by circulating coolant, and warming of the engine body 10 is promoted.

When a temperature of coolant becomes equal to or higher than the pump driving temperature, the coolant pump 8 is driven. However, when a temperature of coolant is still lower than the first reference temperature and the second reference temperature, the first thermostat 91 and the second thermostat 92 are kept closed. Therefore, in this case, coolant flows only through the fourth cooling passage 74, the fifth cooling passage 75, and the first cooling passage 71. Further, coolant that passes through the block-side jacket 31 and the combustion-chamber-side jacket 23 included in the first cooling passage 71, and through the exhaust-port-side jacket 22 communicating with the fourth cooling passage 74, and whose temperature is increased by heat exchange with the engine body 10 increases temperatures of the air bypass valve included in the ABV 60 and the throttle valve included in the ETB 58. Thus, appropriate driving of the ABV 60 and the ETB 58 is secured. Further, since it becomes possible to warm air within the air-conditioning heater 56 by the coolant, it becomes possible to perform appropriate warming in response to a request.

When a temperature of coolant reaches the second reference temperature or higher, the second thermostat 92 is opened. However, when a temperature of coolant is lower than the first reference temperature, the first thermostat 91 is kept closed. Therefore, in this case, the coolant flows through the third cooling passage 73, in addition to the fourth cooling passage 74, the fifth cooling passage 75, and the first cooling passage 71. Then, the coolant whose temperature is increased by passing through the engine body 10 is supplied to the ATF temperature adjuster 51 and the engine oil temperature adjuster 52, and temperatures of ATF and engine oil are increased.

When a temperature of coolant reaches the first reference temperature or higher, the first thermostat 91 is opened, and the coolant further flows through the second cooling passage 72. As the coolant flows through the second cooling passage 72, the coolant is cooled by the radiator 62. In other words, when a temperature of coolant is equal to or higher than the first reference temperature, and warming of the engine body 10 is almost completed, cooling by the radiator 62 is performed, and cooling of the engine body 10 is performed. Further, by the coolant cooled by the radiator 62, EGR gas is cooled within the EGR cooler 54.

In this way, in the embodiment, accompanied by opening of the second thermostat 92, passages through which coolant flows change from the fourth cooling passage 74, the fifth cooling passage 75, and the first cooling passage 71 to the passages 71, 74, 75, and the third cooling passage 73. This increases a flow area of coolant. Therefore, even when a discharge flow rate of the coolant pump 8 is increased after the second thermostat 92 is opened, it is possible to suppress an increase in flow resistance of coolant. Thus, in the embodiment, a discharge flow rate of the coolant pump 8 is increased, accompanied by opening of the second thermostat 92. In other words, the ECU 100 controls the coolant pump 8 in such a manner that a discharge flow rate of the coolant pump 8 increases, accompanied by opening of the second thermostat 92. For example, when a temperature of coolant detected by the coolant temperature sensor SN5 reaches the second reference temperature or higher, the ECU 100 determines that the second thermostat 92 is opened, and controls to increase a discharge flow rate of the coolant pump 8.

Further, in the embodiment, accompanied by opening of the first thermostat 91, coolant is allowed to flow further through the second cooling passage 72. Therefore, even when a discharge flow rate of the coolant pump 8 is increased after the first thermostat 91 is opened, it is possible to suppress an increase in flow resistance of coolant. In view of the above, in the embodiment, a discharge flow rate of the coolant pump 8 is further increased, accompanied by opening of the first thermostat 91. In other words, the ECU 100 controls the coolant pump 8 to increase a discharge flow rate thereof, accompanied by opening of the first thermostat 91. For example, the ECU 100 determines that the first thermostat 91 is opened when a temperature of coolant detected by the coolant temperature sensor SN5 reaches the first reference temperature or higher, and increases a discharge flow rate of the coolant pump 8.

Further, in the embodiment, before or after the second thermostat 92 is opened, and after the first thermostat 91 is opened, heat energy to be supplied to or to be deprived from the air-conditioning heater 56, the ATF temperature adjuster 51, the engine oil temperature adjuster 52, and wall surfaces of the combustion chamber 14 is respectively calculated, and a discharge flow rate of the coolant pump 8 is changed, based on these calculated values.

Specifically, the ECU 100 calculates heat energy to be supplied to the air-conditioning heater 56, based on an operation condition with respect to an operation device for operating the air-conditioning heater 56, in other words, calculates to what degree the temperature of air within the air-conditioning heater 56 should be increased. Further, the ECU 100 calculates a discharge flow rate (hereinafter, referred to as a required discharge flow rate) of the coolant pump 8, which is necessary to secure the required amount of temperature increase, based on the required amount of temperature increase, and a temperature of coolant detected by the coolant temperature sensor SN5, for example.

Further, the ECU 100 calculates heat energy to be supplied to the ATF temperature adjuster 51, based on a temperature of ATF, in other words, calculates to what degree a temperature of ATF should be increased. Further, the ECU 100 calculates a discharge flow rate (hereinafter, referred to as a required discharge flow rate) of the coolant pump 8, which is necessary to secure the required amount of temperature increase, based on the required amount of temperature increase, and a temperature of coolant detected by the coolant temperature sensor SN5, for example.

Further, the ECU 100 calculates heat energy to be deprived from the engine oil temperature adjuster 52, based on a temperature of engine oil, in other words, calculates to what degree a temperature of engine oil should be decreased. Further, the ECU 100 calculates a discharge flow rate (hereinafter, referred to as a required discharge flow rate) of the coolant pump 8, which is necessary to secure the required amount of temperature decrease, based on the required amount of temperature decease and a temperature of coolant, for example.

Further, the ECU 100 estimates a current temperature of wall surfaces of the combustion chamber 14, and calculates a difference between the estimated value and a target value of a temperature of wall surfaces of the combustion chamber 14, in other words, to what degree a temperature of wall surfaces of the combustion chamber 14 should be increased or decreased. Further, the ECU 100 calculates a discharge flow rate (hereinafter, referred to as a required discharge flow rate) of the coolant pump 8, which is necessary to secure the required amount of temperature increase or temperature decrease, based on the required amount of temperature increase or temperature decrease, and a temperature of coolant, for example. A current temperature of wall surfaces of the combustion chamber 14 is estimated, based on a temperature of coolant detected by the coolant temperature sensor SN5, an engine speed detected by the speed sensor SN3, a temperature of intake air detected by the intake air temperature sensor SN4, an engine load, and the like. Further, a target value of a temperature of wall surfaces of the combustion chamber 14 is determined, based on an engine speed, an engine load, and the like.

Further, the ECU 100 calculates a final discharge flow rate of the coolant pump 8, based on the required discharge flow rates respectively calculated regarding the air-conditioning heater 56, the ATF temperature adjuster 51, the engine oil temperature adjuster 52, and wall surfaces of the combustion chamber 14. In the embodiment, the ECU 100 calculates an average value of the required discharge flow rates, and determines the average value as a final discharge flow rate. The final discharge flow rate is not limited to an average value of the required discharge flow rates. The final discharge flow rate may be determined, mainly based on a required discharge flow rate associated with a temperature of wall surfaces of the combustion chamber 14. Further, when the engine is in a high load operation condition, the final discharge flow rate may be determined, based on a maximum required discharge flow rate among the required discharge flow rates.

Further, in the embodiment, the ECU 100 changes a discharge flow rate of the coolant pump 8 also depending on a pressure difference of coolant regarding the coolant pump 8. Specifically, the ECU 100 controls a discharge flow rate of the coolant pump 8 in such a manner that a pressure difference of coolant regarding the coolant pump 8 does not exceed a predetermined value. In the embodiment, a control value (the predetermined value) of a discharge flow rate of the coolant pump 8 is set to vary depending on opening states of the first and second thermostats 91 and 92. When the first and second thermostats 91 and 92 are closed, the control value is a minimum value. When the first and second thermostats 91 and 92 are opened, the control value, which is set taking into consideration the required discharge flow rate, is a maximum value. When the first thermostat 91 is opened, the control value is a value between the minimum value and the maximum value.

(3) Advantageous Effects

As described above, in the embodiment, the head-side jacket 21 is separated into the combustion-chamber-side jacket 23 closer to the combustion chamber 14, and the exhaust-port-side jacket 22 formed around the exhaust ports 16. Further, there are provided the first cooling passage 71 including the combustion-chamber-side jacket 23, and configured to circulate coolant between the coolant pump 8 and the combustion-chamber-side jacket 23; and the sub circulation path 82 including the exhaust-port-side jacket 22, and configured to circulate coolant between the coolant pump 8 and the exhaust-port-side jacket 22 in addition to the first cooling passage 71. Further, the EGR cooler 54 and the air-conditioning heater 56 being heat exchangers, other than the engine body 10, which perform heat exchange with coolant are not provided in the first cooling passage 71 but provided in the fourth cooling passage 74 constituting the sub circulation path 82. Therefore, it is possible to reduce an amount of change in temperature of coolant flowing through the first cooling passage 71, which changes depending on an amount of heat exchange between coolant, EGR gas, and air within the EGR cooler 54 and the air-conditioning heater 56. Therefore, it is possible to stabilize a temperature of coolant flowing through the combustion-chamber-side jacket 23, consequently, a temperature within the combustion chamber 14, while appropriately cooling and warming EGR gas and air within the EGR cooler 54 and the air-conditioning heater 56. Further, this enables to stabilize a combustion state of fuel-air mixture within the combustion chamber 14.

In particular, as described above, since the second cooling passage 72 where the radiator 62 is disposed is closed when a temperature of coolant is lower than the second reference temperature or the first reference temperature, a temperature of coolant is likely to vary depending on an amount of heat exchange in the EGR cooler 54 and the air-conditioning heater 56. Further, a combustion state of fuel-air mixture is likely to be unstable in an operation condition that a temperature of coolant is low and an engine load is low. On the other hand, in the embodiment, since it is possible to reduce a temperature change within the combustion chamber 14 as described above, it is possible to securely stabilize a combustion state of fuel-air mixture even in an operation condition that an engine load is low.

Further, in the embodiment, the block-side jacket 31 constitutes a part of the first cooling passage 71. Therefore, it is possible to stably cool an inner lateral surface of the cylinder 2, in other words, an inner lateral surface of the combustion chamber 14. This enables to securely and stably cool the combustion chamber 14.

Further, the first cooling passage 71 is configured such that coolant after passing through the block-side jacket 31 flows into the combustion-chamber-side jacket 23. Further, the fifth cooling passage 75 is connected to the combustion-chamber-side jacket 23, and the ETB 58 and the ABV 60 are provided in the fifth cooling passage 75. Therefore, it is possible to supply high-temperature coolant after passing through the block-side jacket 31 and a part of the combustion-chamber-side jacket 23 to the ETB 58 and the ABV 60. This is advantageous in appropriately warming the ETB 58 and the ABV 60.

Further, in the embodiment, the EGR cooler 54 is provided downstream of the coolant pump 8 and upstream of the exhaust-port-side jacket 22 within the fourth cooling passage 74. This enables to introduce low-temperature coolant before passing through the exhaust-port-side jacket 22 and before cooling the cylinder block 11 to the EGR cooler 54. This is advantageous in cooling EGR gas within the EGR cooler 54.

Further, since coolant after passing through the EGR cooler 54 is returned to the coolant pump 8 after passing through the exhaust-port-side jacket 22, it is possible to suppress an influence on a temperature of coolant which passes through the exhaust-port-side jacket 22 and then returns to the coolant pump 8 by an amount of heat exchange in the EGR cooler 54. This is advantageous in securely reducing a temperature change of coolant to be fed to the combustion-chamber-side jacket 23 via the coolant pump 8.

In particular, in the embodiment, the air-conditioning heater 56 is provided posterior to the EGR cooler 54, and low-temperature coolant in the EGR cooler 54 is warmed by the air-conditioning heater 56. Therefore, it is possible to reduce a temperature change itself of coolant flowing into the exhaust-port-side jacket 22. Further, providing the air-conditioning heater 56 posterior to the EGR cooler 54 as described above is advantageous in warming air within the air-conditioning heater 56 whose temperature is increased by the coolant whose temperature is increased by the EGR cooler 54.

(4) Modifications

In the embodiment, a case is described in which the EGR cooler 54 and the air-conditioning heater 56 are provided in the fourth cooling passage 74 constituting the sub circulation path 82, as heat exchangers which perform heat exchange with coolant. A specific configuration of a heat exchanger is not limited to this configuration.

Further, a member to be heated, which is provided in the fifth cooling passage 75, and is heated by heat energy of coolant passing through the fifth cooling passage 75, is not limited to the ETB 58 and the ABV 60.

Figure 6:
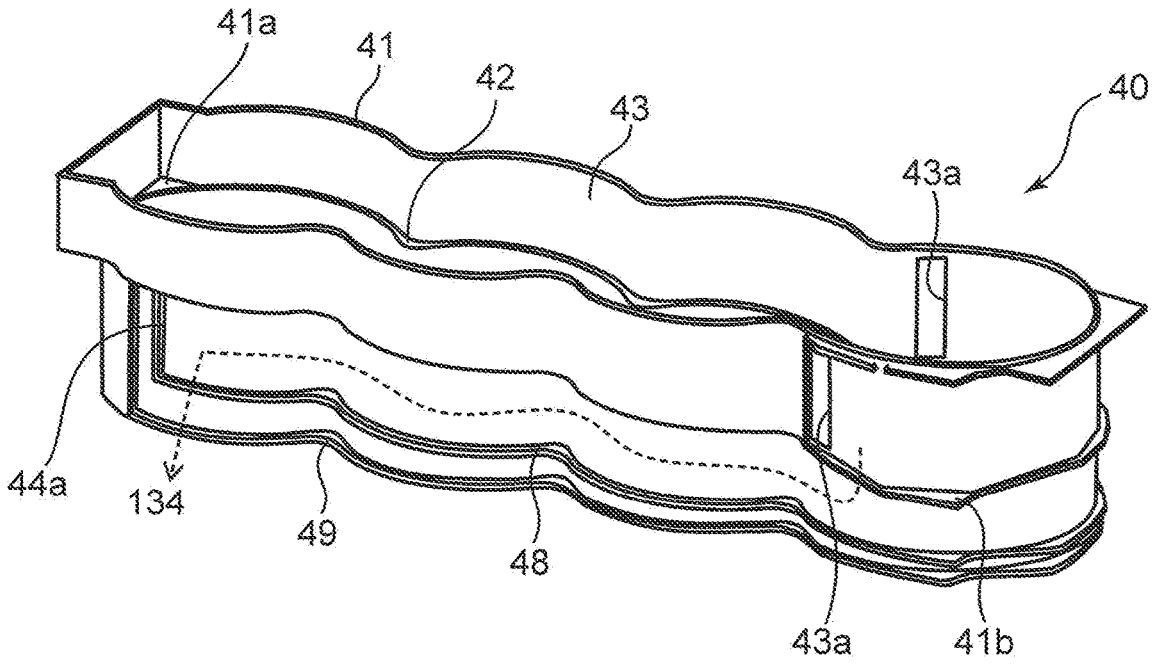
FIG. 6 is a perspective view of a spacer member according to a modification of the present invention when viewed from the exhaust side.

Further, in the embodiment, a case is described in which a passage through which coolant is fed from the coolant pump 8 to the EGR cooler 54 is formed outside the engine body 10. The passage may be formed within the cylinder block 11. For example, the lower flow path 31*d* on the exhaust side in the block-side jacket 31 may be used. In this case, as illustrated in FIG. 6, a radially outwardly projecting projection portion 44*a* is formed on an end of the lower wall 44 of the spacer member 40 on a side opposite to the block-side coolant introducing portion 34 in the left-right direction, in other words, near a left end of the lower wall 44 of the spacer member 40. Further, a bypass discharge portion 134 (indicated by the broken line in FIG. 3) communicating with the block-side jacket 31 and opened toward an outer lateral surface of the cylinder block 11 is formed near a left end of the cylinder block 11. Further, coolant flowing from the block-side coolant introducing portion 34 into an exhaust portion of the lower flow path 31*d* may be blocked by the projection portion 44*a* and guided to the bypass discharge portion 134. Further, the bypass discharge portion 134 and the EGR cooler 54 may be connected to each other.

The present invention includes the following features.

The present invention is directed to a cooling device for an engine including an engine body having a cylinder block and a cylinder head for defining a combustion chamber, and an exhaust port formed in the cylinder head, and a heat exchanger disposed outside the engine body. The cooling device includes: a coolant pump for feeding coolant into the engine body; a head-side jacket formed in the cylinder head, and through which coolant flows; and a circulation path through which coolant discharged from the coolant pump and returning to the coolant pump flows. The head-side jacket includes an exhaust-port-side jacket formed around the exhaust port in the cylinder head, and a combustion-chamber-side jacket formed at a position closer to the combustion chamber than the exhaust-port-side jacket. The circulation path includes a main circulation path through which coolant passing through the combustion-chamber-side jacket circulates, and a sub circulation path through which coolant passing through the exhaust-port-side jacket circulates. The heat exchanger is disposed at a downstream position of the sub circulation path with respect to the coolant pump, and at an upstream position of the sub circulation path with respect to the exhaust-port-side jacket.

According to the aforementioned configuration, the head-side jacket is separated into the combustion-chamber-side jacket closer to the combustion chamber, and the exhaust-port-side jacket formed around the exhaust port. Further, a heat exchanger which performs heat exchange with coolant is not provided in the main circulation path where the combustion-chamber-side jacket is formed, but is provided in the sub circulation path where the exhaust-port-side jacket is formed. This is advantageous in stably and appropriately cooling the combustion chamber by reducing a temperature change of coolant flowing to the combustion-chamber-side jacket, while appropriately warming or cooling target fluid by the heat exchanger. Further, this is advantageous in securely stabilizing a combustion state of fuel-air mixture within the combustion chamber.

Preferably, the cooling device may further include a branch path connecting the combustion-chamber side jacket, and an upstream portion of the sub circulation path with respect to the exhaust-port-side jacket, and configured to introduce coolant within the combustion-chamber-side jacket to the sub circulation path. The main circulation path may include a block-side jacket formed in the cylinder block and through which coolant flows, and may be configured in such a manner that coolant fed from the coolant pump passes through the combustion-chamber-side jacket after passing through the block-side jacket. A member to be heated that is warmed by heat energy of coolant passing through the branch path may be provided in the branch path.

According to the aforementioned configuration, since the block-side jacket formed in the cylinder block is formed in the main circulation path, it is possible to stably and appropriately cool the cylinder block, consequently, the combustion chamber. Further, in this configuration, a part of coolant whose temperature is increased by passing through the block-side jacket and the combustion-chamber-side jacket is introduced to the member to be heated. This is advantageous in securely warming the member to be heated, and increasing a temperature of the member to be heated at an earlier stage.

Preferably, the cooling device may further include a radiator for cooling coolant to be fed from the coolant pump. The heat exchanger may include an EGR cooler for cooling EGR gas being exhaust gas flowing back to intake air to be drawn into the engine body, out of exhaust gas discharged from the engine body, and an air-conditioning heater. The EGR cooler and the air-conditioning heater may be disposed at such positions that coolant discharged from the coolant pump in the sub circulation path flows to the EGR cooler, the air-conditioning heater, and the exhaust-port-side jacket in this order.

According to the aforementioned configuration, it is possible to efficiently warm or cool the EGR cooler (EGR gas), the air-conditioning heater (air flowing through the heater), and the exhaust-port-side jacket (coolant flowing through the exhaust-port-side jacket), respectively. Specifically, it is possible to effectively cool EGR gas by introducing coolant of a relatively low temperature which is cooled by the radiator to the EGR cooler first of all. Then, it is possible to effectively warm the air-conditioning heater (air flowing through the heater) by introducing the coolant whose temperature is increased by heat exchange within the EGR cooler to the air-conditioning heater. Further, it is possible to effectively cool the exhaust port and its periphery by introducing coolant cooled by heat exchange within the air-conditioning heater to the exhaust-port-side jacket.

This application is based on Japanese Patent Application No. 2017-151553 filed on Aug. 4, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A cooling device for an engine including an engine body having a cylinder block and a cylinder head for defining a combustion chamber, and an exhaust port formed in the cylinder head, and a heat exchanger disposed outside the engine body, the cooling device comprising:

a coolant pump for feeding coolant into the engine body;

a head-side jacket formed in the cylinder head, and through which coolant flows;

a circulation path through which coolant discharged from the coolant pump and returning to the coolant pump flows; and a branch path, wherein the head-side jacket includes an exhaust-port-side jacket formed around the exhaust port in the cylinder head, and a combustion-chamber-side jacket formed at a position closer to the combustion chamber than the exhaust-port-side jacket, the circulation path includes a main circulation path through which coolant passing through the combustion-chamber-side jacket circulates, and a sub circulation path through which coolant passing through the exhaust-port-side jacket circulates, the heat exchanger is disposed at a downstream position of the sub circulation path with respect to the coolant pump, and at an upstream position of the sub circulation path with respect to the exhaust-port-side jacket, the branch path connects the combustion-chamber-side jacket, and an upstream portion of the sub circulation path with respect to the exhaust-port-side jacket, and is configured to introduce coolant within the combustion-chamber-side jacket to the sub circulation path, the main circulation path includes a block-side jacket formed in the cylinder block and through which coolant flows, and is configured in such a manner that coolant fed from the coolant pump passes through the combustion-chamber-side jacket after passing through the block-side jacket, a member to be heated that is warmed by heat energy of coolant passing through the branch path is provided in the branch path, and the member includes an electronic throttle body and an air bypass valve body.

* * * * *